US007918527B2

(12) United States Patent
Borders et al.

(10) Patent No.: US 7,918,527 B2
(45) Date of Patent: Apr. 5, 2011

(54) METHOD FOR USE IN ACHIEVING VELOCITY OPTIMIZATION FOR A PRINTHEAD

(75) Inventors: Marcus Landon Borders, Lexington, KY (US); Godfrey Adlawan Golpeo, Cebu (PH); Tommy Otis Lowe, Lexington, KY (US); Emmanuel John Corro Ruelan, Mandaue (PH)

(73) Assignee: Lexmark International, Inc., Lexington, KY (US)

( * ) Notice: Subject to any disclaimer, the term of this patent is extended or adjusted under 35 U.S.C. 154(b) by 826 days.

(21) Appl. No.: 11/746,121

(22) Filed: May 9, 2007

(65) Prior Publication Data

US 2008/0278533 A1 Nov. 13, 2008

(51) Int. Cl.
*B41J 29/393* (2006.01)

(52) U.S. Cl. ..... 347/19; 347/14; 347/10

(58) Field of Classification Search ..... 347/19, 347/14, 17, 5, 9, 10–11
See application file for complete search history.

(56) References Cited

U.S. PATENT DOCUMENTS

| | | | | |
|---|---|---|---|---|
| 6,575,548 | B1 * | 6/2003 | Corrigan et al. | 347/19 |
| 6,631,969 | B2 * | 10/2003 | Nagoshi et al. | 347/19 |
| 6,705,694 | B1 * | 3/2004 | Barbour et al. | 347/9 |
| 6,827,413 | B1 * | 12/2004 | Kawatoko et al. | 347/14 |
| 6,866,359 | B2 * | 3/2005 | Pan et al. | 347/19 |
| 2005/0134621 | A1 * | 6/2005 | Miyakoshi et al. | 347/10 |

* cited by examiner

*Primary Examiner* — Lam S Nguyen

(57) ABSTRACT

A method for use with an imaging apparatus that mounts a printhead having a plurality of ink jetting actuators formed on a substrate that correspond to a plurality of ink jetting nozzles includes determining a resistance associated with the printhead; accessing a memory having stored therein a plurality of individually selectable fire pulse energy values; selecting a first fire pulse energy value of the plurality of individually selectable fire pulse energy values based on the resistance that was determined; and using the first fire pulse energy value for actuating at least one of the plurality of ink jetting actuators during a printing operation.

8 Claims, 5 Drawing Sheets

METHOD FOR USE IN ACHIEVING VELOCITY OPTIMIZATION FOR A PRINTHEAD

CROSS-REFERENCE TO RELATED APPLICATIONS

None.

MICROFICHE APPENDIX

None.

GOVERNMENT RIGHTS IN PATENT

None.

BACKGROUND OF THE INVENTION

1. Field of the Invention

The present invention relates to an ink jet imaging apparatus that prints using at least one ink jetting printhead, and, more particularly, to a method for use in achieving velocity optimization for the printhead.

2. Description of the Related Art

An ink jet imaging apparatus, such as an ink jet printer, forms an image on a print medium, such as paper, by ejecting ink onto the print medium. Such an ink jet printer may include a reciprocating printhead carrier that transports one or more printheads across the print medium along a bi-directional scanning path defining a print zone of the printer. The printhead is in fluid communication with an ink supply.

Such a printhead includes a plurality of nozzles having corresponding ink ejection actuators, such as resistive heater elements. The manufacture of printheads involves certain manufacturing tolerances resulting in manufacturing variations, which in turn result in printheads that require various amounts of energy to attain appropriate drop velocities for the ink. Thus, typically, from printhead to printhead, the amount of energy required to obtain a sufficiently high drop velocity varies. Because of these manufacturing variations, an energy level for driving such printheads typically will be selected so that most printheads will attain a certain minimum drop velocity, without any attempt at velocity optimization.

One prior method for performing velocity optimization for a printhead involves the printing of line patterns at various fire pulse energy levels. The line patterns are then scanned, e.g., by as scanner or optical sensor, and the scanned data is processed through special algorithms to select a desired energy level. Such a method, however, necessitates that the imaging apparatus have some sort of scanning device in order to perform the velocity optimization, requires the use of ink for generating the line patterns, and requires user interaction at least to the extent of feeding the page having the line pattern back through the imaging apparatus for scanning.

What is needed in the art is a method for performing velocity optimization that does not require, for example, the generation or scanning of a line pattern.

SUMMARY OF THE INVENTION

Terms such as "first" or "second" preceding an element name, e.g., first fire pulse energy value, etc., are used for identification purposes to distinguish between similar elements, and are not intended to necessarily imply order, nor are such terms intended to preclude the inclusion of additional similar elements.

The invention, in one form thereof, is directed to a method for use with an imaging apparatus that mounts a printhead having a plurality of ink jetting actuators formed on a substrate that correspond to a plurality of ink jetting nozzles. The method includes determining a resistance associated with the printhead; accessing a memory having stored therein a plurality of individually selectable fire pulse energy values; selecting a first fire pulse energy value of the plurality of individually selectable fire pulse energy values based on the resistance that was determined; and using the first fire pulse energy value for actuating at least one of the plurality of ink jetting actuators during a printing operation.

The invention, in another form thereof, is directed to an imaging apparatus including a print engine. A printhead is mounted to the print engine. The printhead has a plurality of ink jetting actuators formed on a substrate that correspond to a plurality of ink jetting nozzles. A controller is communicatively coupled to the print engine. The controller executes program instructions for performing velocity optimization for the printhead, including the acts of determining a resistance associated with the printhead; accessing a memory having stored therein a plurality of individually selectable fire pulse energy values; selecting a first fire pulse energy value of the plurality of individually selectable fire pulse energy values based on the resistance that was determined; and using the first fire pulse energy value for actuating at least one of the plurality of ink jetting actuators during a printing operation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
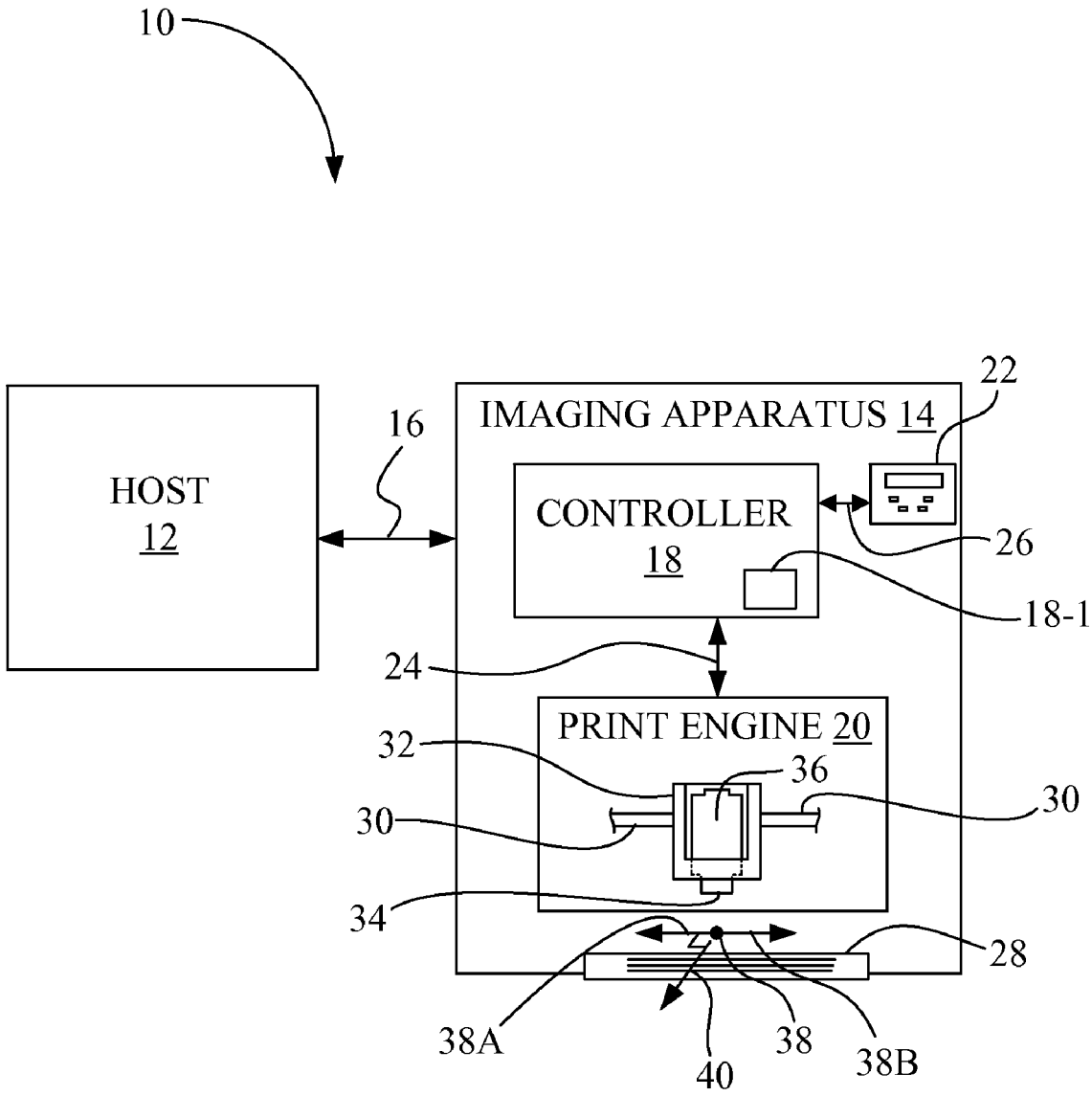
FIG. 1 is a diagrammatic depiction of an imaging system embodying the present invention, including an imaging apparatus mounting a printhead.

Referring to FIG. 1, there is shown a diagrammatic depiction of an imaging system 10 embodying the present invention. Imaging system 10 may include a host 12 and an imaging apparatus 14. Imaging apparatus 14 may communicate with host 12 over a communications link 16. As used herein, the term "communications link" is used to generally refer to structure that facilitates electronic communication between multiple components, and may operate using wired or wireless technology. Imaging apparatus 14 may communicate with host 12 via a standard communication protocol, such as for example, universal serial bus (USB), Ethernet or IEEE 802.1x, etc.

As used herein, the term "imaging apparatus" is a device that forms a printed image on a print medium. In the embodiment shown in FIG. 1, imaging apparatus 14 is shown as a printer that includes a controller 18, a print engine 20 and a user interface 22. Alternatively, imaging apparatus 14 may be a standalone unit that is not communicatively linked to a host, such as host 12. For example, imaging apparatus 14 may take the form of an all-in-one, i.e., multifunction, machine that includes a scanner to facilitate standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including program instructions that function as an imaging driver, e.g., printer driver software, for imaging apparatus 14. Alternatively, the imaging driver may be incorporated, in whole or in part, in imaging apparatus 14.

Controller 18 of imaging apparatus 14 includes a processor unit and associated memory, and may be formed as an Application Specific Integrated Circuit (ASIC). Controller 18 has access at a memory 18-1, which may be formed integral with controller 18 in the ASIC, or alternative may be a separate memory module. Controller 18 communicates with print engine 20 by way of a communications link 24. Controller 18 communicates with user interface 22 by way of a communications link 26. Communications links 24 and 26 may be established, for example, by using standard electrical cabling or bus structures, or by wireless connection.

Print engine 20 of imaging apparatus 14 may be, for example, an ink jet print engine configured for forming an image on a sheet of print media 28, such as a sheet of paper, transparency or fabric. Print engine 20 may include, for example, a guide frame 30 and a reciprocating printhead carrier 32 slidably coupled to guide frame 30. Printhead carrier 32 is mechanically and electrically configured to mount and carry at least one printhead 34. Printhead 34 is in fluid communication with an ink tank 36. In one embodiment, for example, ink tank 36 and printhead 34 may be formed as an integral printhead cartridge, so as to be replaceable as a unit. In another embodiment, printhead 34 and ink tank 36 may be designed to be separable, so as to be individually replaceable.

Guide frame 30 defines a bi-directional main scan path 38, including direction 38A and direction 38B. During a printing operation, guide frame 30 guides printhead carrier 32 back and forth along bi-directional main scan path 38, and in turn printhead carrier 32 transports, i.e., scans, printhead 34 in a reciprocating manner over an image surface of the sheet of print media 28. Also, between scans of printhead carrier 32, the sheet of print media 28 may be advanced in an indexed fashion in a sheet feed direction 40, which is substantially perpendicular to bi-directional main scan path 38.

Figure 2:
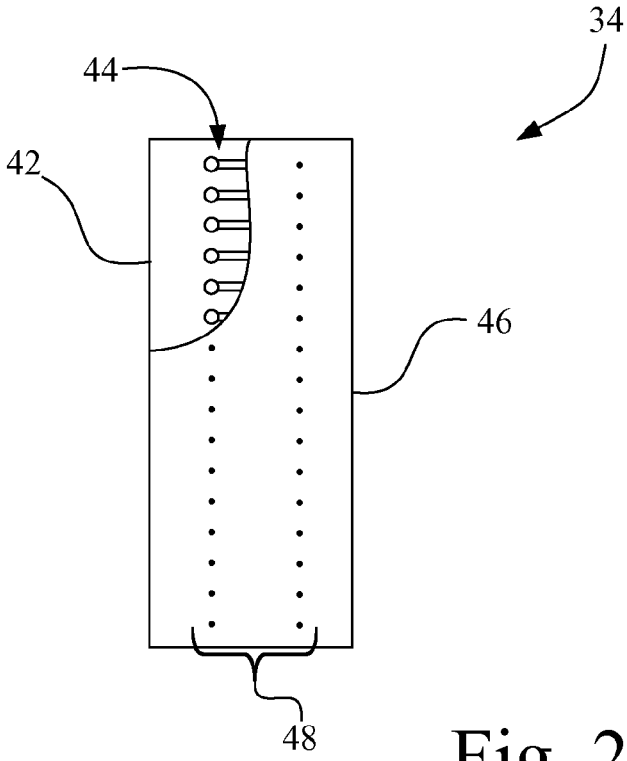
FIG. 2 is a diagrammatic depiction of the printhead of FIG. 1, with a portion broken away to expose the substrate.

Printhead 34 is controlled, e.g., by controller 18, to selectively eject ink to form an image on the sheet of print media 28 during each scan of printhead 34 over the sheet of print media 28. Referring to FIG. 2, printhead 34 includes a substrate, e.g., a silicon chip, 42 having a plurality of ink passages and chambers 44 for receiving and transporting ink. A nozzle plate 46 having a plurality of ink jetting nozzles 48 is attached to substrate 42, with the plurality of ink jetting nozzles 48 being in fluidic communications with the chambers 44 of substrate 42.

Figure 3:
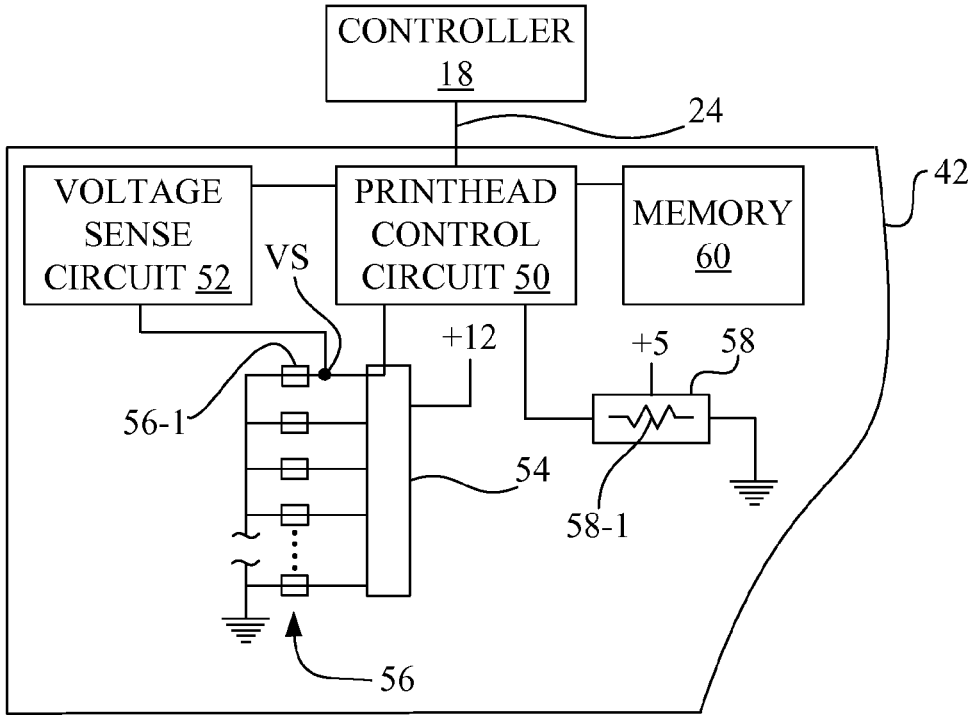
FIG. 3 is a block diagram of exemplary electrical components formed on the substrate of the printhead of FIG. 2.

Referring also to FIG. 3, formed on substrate 42, for example, is a printhead control circuit 50, a voltage sense circuit 52, an actuator control logic circuit 54, a plurality of ink jetting actuators 56, a reference resistive device 58, and a memory 60.

Printhead control circuit 50 is communicatively coupled to controller 18 via communications link 24. Memory 60 is electrically coupled to printhead control circuit 50, and is accessible by controller 18 and/or printhead control circuit 50. Memory 60 may be used to store information associated with printhead 34.

Printhead control circuit 50 is electrically coupled to actuator control logic circuit 54, which in turn is electrically connected to the plurality of ink jetting actuators 56. A voltage source +12 provides electrical power to actuator control logic circuit 54 and the plurality of ink jetting actuators 56. Each of the plurality of ink jetting actuators 56 may be, for example, a resistive heater element, or alternatively a piezoelectric element. The plurality of ink jetting actuators 56 is respectively associated with the plurality of chambers 44, and in turn with the plurality of ink jetting nozzles 48. In one embodiment, for example, each of ink jetting actuators 56 may be associated with a respective one of the plurality of ink jetting nozzles 48, such that when actuated, the ink jetting actuator will cause an ink drop to be ejected from the respective ink jetting nozzle.

Voltage sense circuit 52 (which in some embodiments may be optional) is provided to sense an actual voltage, VS, applied across one or more of the plurality of ink jetting actuators 56. In the embodiment shown in FIG. 3, for example, voltage sense circuit 52 is electrically connected to sense the actual voltage VS applied across ink jetting actuator 56-1 of the plurality of ink jetting actuators 56. Printhead control circuit 50 senses the current flowing through the reference resistance provided by ink jetting actuator 56-1. Based on a sensed voltage, e.g., 10.8 volts, sensed by voltage sense circuit 52 applied across the reference resistance provided by ink jetting actuator 56-1, and the current determined by printhead control circuit 50, the resistance of ink jetting actuator 56-1 may be determined using Ohm's law, such as for example, by a calculation performed by controller 18. If, for example, the current supplied by actuator control logic circuit 54 to ink jetting actuator 56-1 is a constant, then a resistance of ink jetting actuator 56-1 will be proportional to the sensed voltage VS. As a further example, a small resistance, e.g., 1 ohm, may be inserted into a conductive path leading to one or more of the plurality of ink jetting actuators 56 to form a voltage divider from which the resistance of the unknown resistance associated with the ink jetting actuator(s) may be found.

Reference resistive device 58 (which in some embodiments may be optional) is electrically connected to printhead control circuit 50. Reference resistive device 58 includes at least one reference resistor 58-1. In one embodiment, for example, reference resistive device 58 may include a string of series connected resistors, with the resistance of each resistor in the series string being selected to simulate the resistance of an ink jetting actuator.

The resistance of reference resistive device 58 may be, for example, some value between 1 ohm and 1000 ohms. Electrically connected to reference resistive device 58 is a voltage source +5. Printhead control circuit 50 senses the current flowing through reference resistive device 58, and based on an assumption of 5 volts being applied across reference resistive device 58, the resistance of reference resistive device 58 may be determined using Ohm's law, such as for example, by a calculation performed by controller 18.

Figure 4:
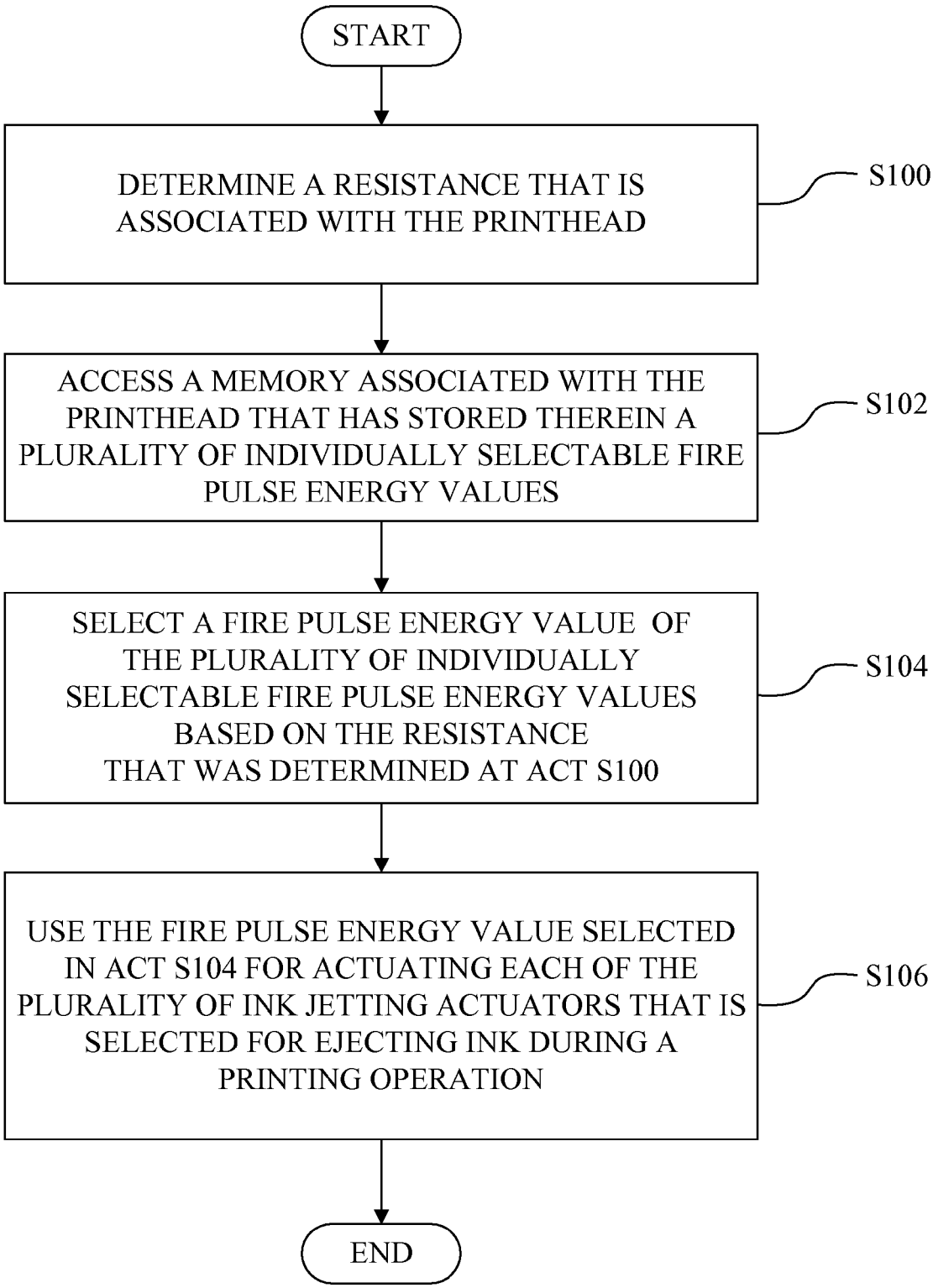
FIG. 4 is a flowchart of a method for use with the imaging apparatus to achieve velocity optimization for the printhead of FIG. 1.

FIG. 4 is a flowchart of a method for use with imaging apparatus 14 to achieve velocity optimization for printhead 34. Velocity optimization optimizes an amount of energy delivered to each respective ink jetting actuator of the plurality of ink jetting actuators 56, without exceeding the energy capability of the respective ink jetting actuator of the plurality of ink jetting actuators 56. The method of FIG. 4 may be implemented, for example, as program instructions executed by controller 18.

At act S100, a resistance is determined that is associated with printhead 34. This resistance may be, for example, a resistance of at least one of the plurality of ink jetting actuators 56, such as ink jetting actuator 56-1, or reference resistive device 58 which is separate from any of the plurality of ink jetting actuators 56.

At act S102, a memory, such as memory 60 associated with printhead 34, is accessed that has stored therein a plurality of individually selectable fire pulse energy values. In one embodiment, for example, the discrete individually selectable fire pulse energy values may be, for example, in a range of 1.10 to 1.40 micro Joules (uJ), in 0.01 micro Joule increments.

The plurality of individually selectable fire pulse energy values may correspond, for example, to a plurality of individually selectable fire pulse width values that are used in achieving a velocity optimization for printhead 34. The plurality of individually selectable fire pulse energy values may be determined empirically, for example, by collecting data associated with a plurality of similar printheads. The plurality of individually selectable fire pulse energy values may be stored in memory 60, for example, as a lookup table. Alternatively, the plurality of individually selectable fire pulse energy values may be stored, for example, in memory 18-1 associated with controller 18, or other accessible memory location.

At act S104, a first fire pulse energy value EV1 of the plurality of individually selectable fire pulse energy values is selected based on the resistance that was determined at act S100. The resistance may be represented as a pointer value for use in selecting one of the plurality of individually selectable fire pulse energy values stored in the lookup table in memory 60. For example, a resistance value of 750 ohms may correspond to 1.30 micro Joules. Also, it is contemplated that a limited range of resistance values, e.g., 730 to 770 ohms, may correspond to the same fire pulse energy value, if desired.

At act S106, the fire pulse energy value EV1 selected in act S104 is used by controller 18 and/or printhead control circuit 50 for actuating each of the plurality of ink jetting actuators 56 that is selected for ejecting ink during a printing operation.

Figure 5:
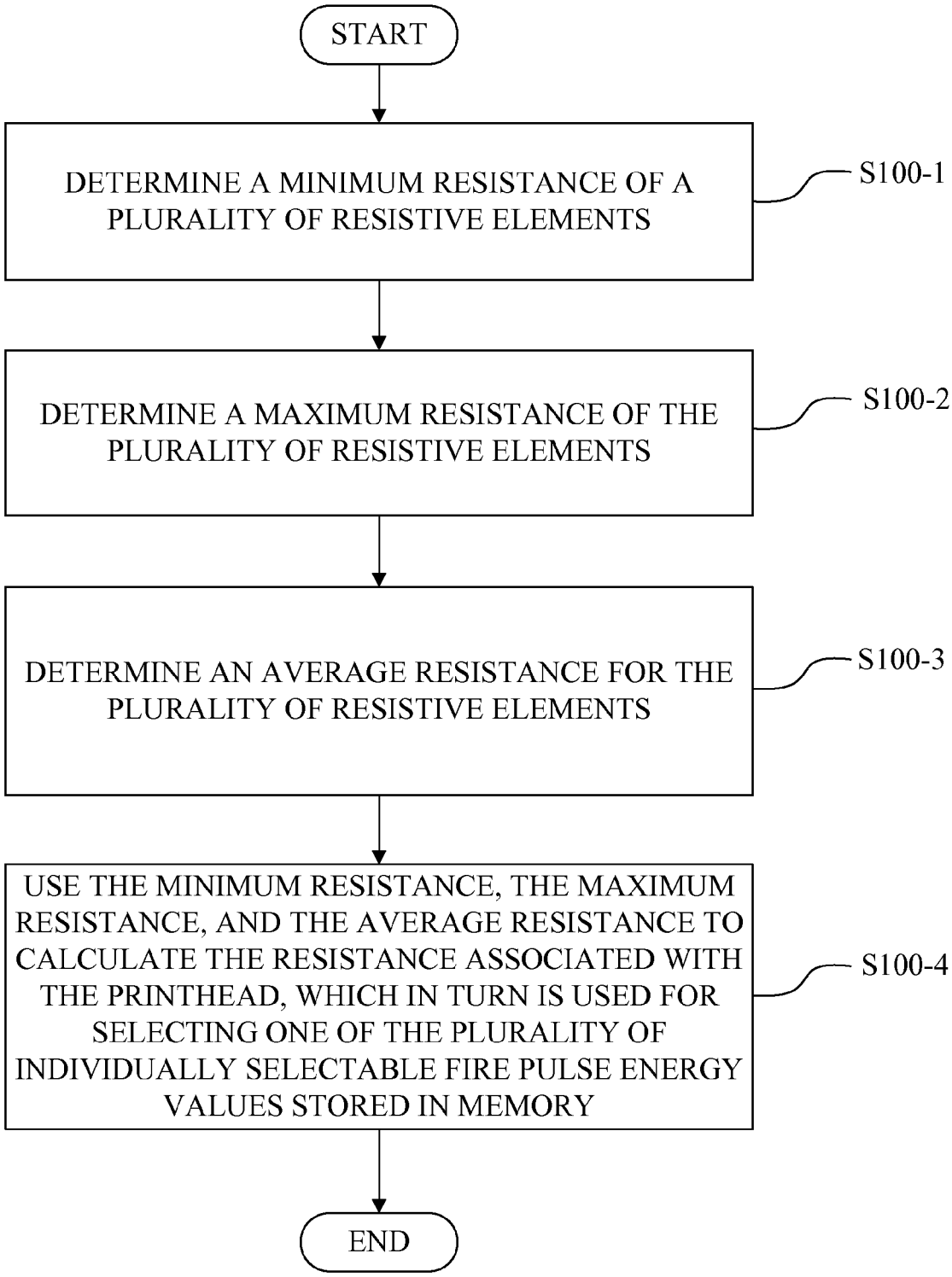
FIG. 5 is a flowchart of one variation for use in performing the act of determining the resistance in the method of FIG. 4.

FIG. 5 is a flowchart of one variation for use in performing act S100 of FIG. 4 in determining the resistance. The method variation of FIG. 5 may be implemented, for example, as program instructions executed by controller 18.

At act S100-1, a minimum resistance of a plurality of resistive elements, e.g., two or more of the plurality of ink jetting actuators 56, is determined.

At act S100-2, a maximum resistance of the plurality of resistive elements is determined.

At act S100-3, an average resistance for the plurality of resistive elements is determined.

At act S100-4, the minimum resistance, maximum resistance, and average resistance are used to calculate the resistance associated with printhead 34, which in turn is used for selecting one of the plurality of individually selectable fire pulse energy values stored in memory, e.g., memory 60 or memory 18-1, for use in printing with printhead 34. For example, the average resistance may be the average of the minimum resistance and the maximum resistance, wherein the average resistance is used as the resistance for selecting one of the plurality of individually selectable fire pulse energy values from the lookup table stored in memory 60 or memory 18-1.

Figure 6:
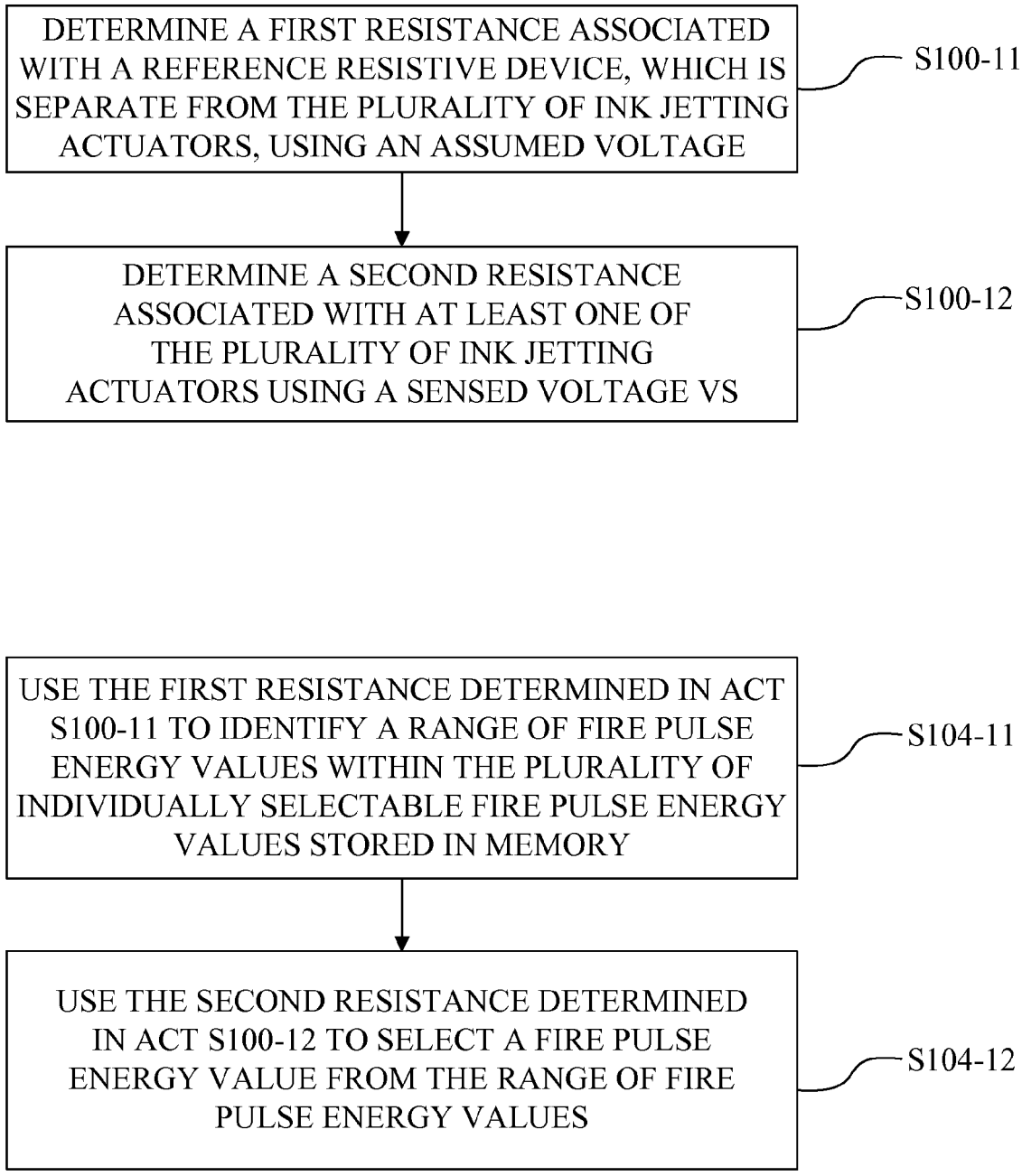
FIG. 6 is a flowchart of another variation of the present invention for use in performing the method of FIG. 4.

FIG. 6 is a flowchart of another variation of the present invention for use in performing acts S100 and S104 in method of FIG. 4. The method variation of FIG. 6 may be implemented, for example, as program instructions executed by controller 18.

At act S100-11, a first resistance associated with reference resistive device 58, which is separate from the plurality of ink jetting actuators 56, is determined using an assumed voltage. In the present example, the assumed voltage is the nominal voltage applied to reference resistive device 58, regardless of the actual voltage applied to reference resistive device 58 (see FIG. 3).

At act S100-12, a second resistance associated with at least one of the plurality of ink jetting actuators 56 is determined using the sensed voltage VS, i.e., a measured actual voltage as sensed by voltage sense circuit 52. In the present example, voltage sense circuit 52 senses the voltage drop across ink jetting actuator 56-1.

Act S102 may be performed, as described above.

At act S104-11, the first resistance determined in act S100-11 is used to identify a range of fire pulse energy values within the plurality of individually selectable fire pulse energy values stored in memory, e.g., memory 60 and/or memory 18-1.

At act S104-12, the second resistance determined in act S100-12 is used to select the first fire pulse energy value EV1 from the range of fire pulse energy values. If desired, the second resistance may be represented by the sensed voltage VS, so that the actual calculation of the second resistance is not necessary.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for use with an imaging apparatus that mounts a printhead having a plurality of ink jetting actuators formed on a substrate that correspond to a plurality of ink jetting nozzles, comprising:

determining a resistance associated with said printhead;

accessing a memory having stored therein a plurality of individually selectable fire pulse energy values;

selecting a first fire pulse energy value from said plurality of individually selectable fire pulse energy values based on said resistance that was determined; and using said first fire pulse energy value for actuating at least one of said plurality of ink jetting actuators during a printing operation, wherein the determining said resistance includes determining a first resistance associated with a resistive device separate from said plurality of ink jetting actuators; and determining a second resistance associated with at least one of said plurality of ink jetting actuators; and wherein the selecting includes using said first resistance to identify a range of fire pulse energy values within said plurality of individually selectable fire pulse energy values; and using said second resistance to select said first fire pulse energy value from said range of fire pulse energy values.

2. The method of claim 1, wherein said plurality of individually selectable fire pulse energy values correspond to a plurality of individually selectable fire pulse width values that are used in achieving a velocity optimization for said printhead, said velocity optimization optimizing an amount of energy delivered to each respective ink jetting actuator of said plurality of ink jetting actuators without exceeding an energy capability of said each respective ink jetting actuator of said plurality of ink jetting actuators.

3. The method of claim 1, wherein each of said plurality of ink jetting actuators is a resistive heater.

4. The method of claim 1, wherein the act of determining said resistance includes:

determining a minimum resistance of a plurality of resistive elements;

determining a maximum resistance of said plurality of resistive elements;

determining an average resistance for said plurality of resistive elements; and using said minimum resistance, said maximum resistance, and said average resistance to calculate said resistance associated with said printhead for selecting one of said plurality of individually selectable fire pulse energy values for use in printing with said printhead.

5. An imaging apparatus, comprising:

a print engine;

a printhead mounted to said print engine, said printhead having a plurality of ink jetting actuators formed on a substrate that correspond to a plurality of ink jetting nozzles; and a controller communicatively coupled to said print engine, said controller executing program instructions for performing velocity optimization for said printhead, including determining a resistance associated with said printhead;

accessing a memory having stored therein a plurality of individually selectable fire pulse energy values;

selecting a first fire pulse energy value from said plurality of individually selectable fire pulse energy values based on said resistance that was determined; and using said first fire pulse energy value for actuating at least one of said plurality of ink jetting actuators during a printing operation wherein the determining said resistance includes determining a first resistance associated with a resistive device separate from said plurality of ink jetting actuators; and determining a second resistance associated with at least one of said plurality of ink jetting actuators; and wherein the selecting includes using said first resistance to identify a range of fire pulse energy values within said plurality of individually selectable fire pulse energy values; and using said second resistance to select said first fire pulse energy value from said range of fire pulse energy values.

6. The imaging apparatus of claim 5, wherein said plurality of individually selectable fire pulse energy values correspond to a plurality of individually selectable fire pulse width values that are used in achieving said velocity optimization for said printhead, said velocity optimization optimizing an amount of energy delivered to each respective ink jetting actuator of said plurality of ink jetting actuators without exceeding an energy capability of said each respective ink jetting actuator of said plurality of ink jetting actuators.

7. The imaging apparatus of claim 5, wherein each of said plurality of ink jetting actuators is a resistive heater.

8. The imaging apparatus of claim 5, wherein the controller is configured to determine said resistance by performing the following acts:

determining a minimum resistance of a plurality of resistive elements;

determining a maximum resistance of said plurality of resistive elements;

determining an average resistance for said plurality of resistive elements; and using said minimum resistance, said maximum resistance, and said average resistance to calculate said resistance associated with said printhead for selecting one of said plurality of individually selectable fire pulse energy values for use in printing with said printhead.

* * * * *